US007604237B2

(12) United States Patent
Czekanski

(10) Patent No.: US 7,604,237 B2
(45) Date of Patent: Oct. 20, 2009

(54) MATH GAME AND METHOD

(76) Inventor: Marek Czekanski, 4001 Bayview Ave, Apt 420, Toronto, Ontario (CA) M2M 3Z7

( * ) Notice: Subject to any disclaimer, the term of this patent is extended or adjusted under 35 U.S.C. 154(b) by 0 days.

(21) Appl. No.: 11/652,700

(22) Filed: Jan. 12, 2007

(65) Prior Publication Data

US 2008/0169608 A1 Jul. 17, 2008

(51) Int. Cl.
*A63F 3/00* (2006.01)

(52) U.S. Cl. ..... 273/309; 273/288
(58) Field of Classification Search ..... 273/288, 273/299, 290, 236, 309; D21/386, 385
See application file for complete search history.

(56) References Cited

U.S. PATENT DOCUMENTS

| | | | | | |
|---|---|---|---|---|---|
| 3,345,759 | A * | 10/1967 | Harris | 434/209 |
| 3,547,444 | A * | 12/1970 | Williams et al. | 273/294 |
| 4,212,117 | A * | 7/1980 | Baldwin et al. | 434/208 |
| 4,236,720 | A * | 12/1980 | Belony | 273/292 |
| 4,360,347 | A * | 11/1982 | Ghaznavi | 434/198 |
| 4,419,081 | A * | 12/1983 | Steinmann | 434/188 |
| D343,647 | S * | 1/1994 | Adell | D21/386 |
| 5,314,190 | A * | 5/1994 | Lyons | 273/272 |
| 6,062,566 | A * | 5/2000 | Lemons | 273/293 |
| 6,755,419 | B2 * | 6/2004 | Markus | 273/273 |
| 2003/0141662 | A1 * | 7/2003 | Kost et al. | 273/288 |

* cited by examiner

*Primary Examiner*—Vishu K. Mendiratta
(74) *Attorney, Agent, or Firm*—Bereskin & Parr

(57) ABSTRACT

A math game is described herein which can effectively improve one's math skills while being simple, entertaining, and eye-pleasing. Players attach randomly selected octagonal tiles that bare digits in the middle and math operation symbols on their sides creating various numbers. Then they join two of his/her numbers to the number from the table creating math equation. The player that exhausts his tiles first is the winner of the game.

11 Claims, 9 Drawing Sheets

MATH GAME AND METHOD

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF INVENTIONS

1. Field of the Invention

The present invention relates to a math learning game and more particularly pertains to encouraging practicing of the four basic arithmetic operations on various number types, 2. Description of the Prior Art The use of educational games is known in the prior art. While these games fulfill their respective, particular objectives and requirements, there still is a need for a game that is both educational, nice looking, exciting for students of different math levels, and can be played by various numbers of players.

SUMMARY OF THE INVENTION

The game presented here prompts the players to perform math operations on randomly given number tiles. While attaching new tiles to the tiles on the table, the players perform numerous math operations and create colorful patterns.

The main object of the present invention is to provide a game that stimulates the players to practice the four arithmetic operations. To attain this, the players are randomly given octagonal tiles with numbers from 0 to 9 that are used to create mathematical operations. The players are prompted to consider numerous arithmetic operations in search for the true one.

Another object of the invention is to provide a game that can be played by players of various math levels. Since the player who exhausts his/her tiles first wins, the players are prompted to consider numerous arithmetic operations on various number types (such as multi-digit numbers or/and fractions) in search for the best math operation that exhausts the biggest number of tiles. The higher is level of math competency of the players, the more fancy moves they can make.

Like in most other games, the object of the present invention is to provide a game that is exciting to the players. This is achieved via following elements of the creative intelligence and luck:

a) Tiles are randomly distributed among the players.
b) The more fancy is the move, the more tiles the player exhausts.
c) Tiles with the result of the operation can be placed in the way that is detrimental to opponents.
d) "Wildcard" tiles can be used instead of any digit.
e) "Wildcard" tiles can be replaced for the right tile by the next player Another object of the present invention is to provide a game easy to comprehend. It is achieved by one simple game move that can be learned practically in a few seconds. The same move that is used for all kinds of math operations. To attain this, the octagonal tiles have assigned signs of the four math operations on four of their sides and four "=" symbols on sides between them. Attaching new tiles to tiles from the table by matching sides with the same signs constitutes the move.

Still yet another object of the present invention is to create a game that can be played by different number of players. The standard game set allows 2 to 4 players to play the game together. For higher number of players, additional tiles can be added form another game set.

The final object of the present invention is to create a game that is visually pleasing. As the game progresses the players create on the table randomly generated fractural-like colorful patterns.

DESCRIPTION OF THE INVENTION

With reference to the drawings, and in particular to FIG. 1 through 9, a new math game embodying the principles and concepts of the present invention will be described.

Figure 1:
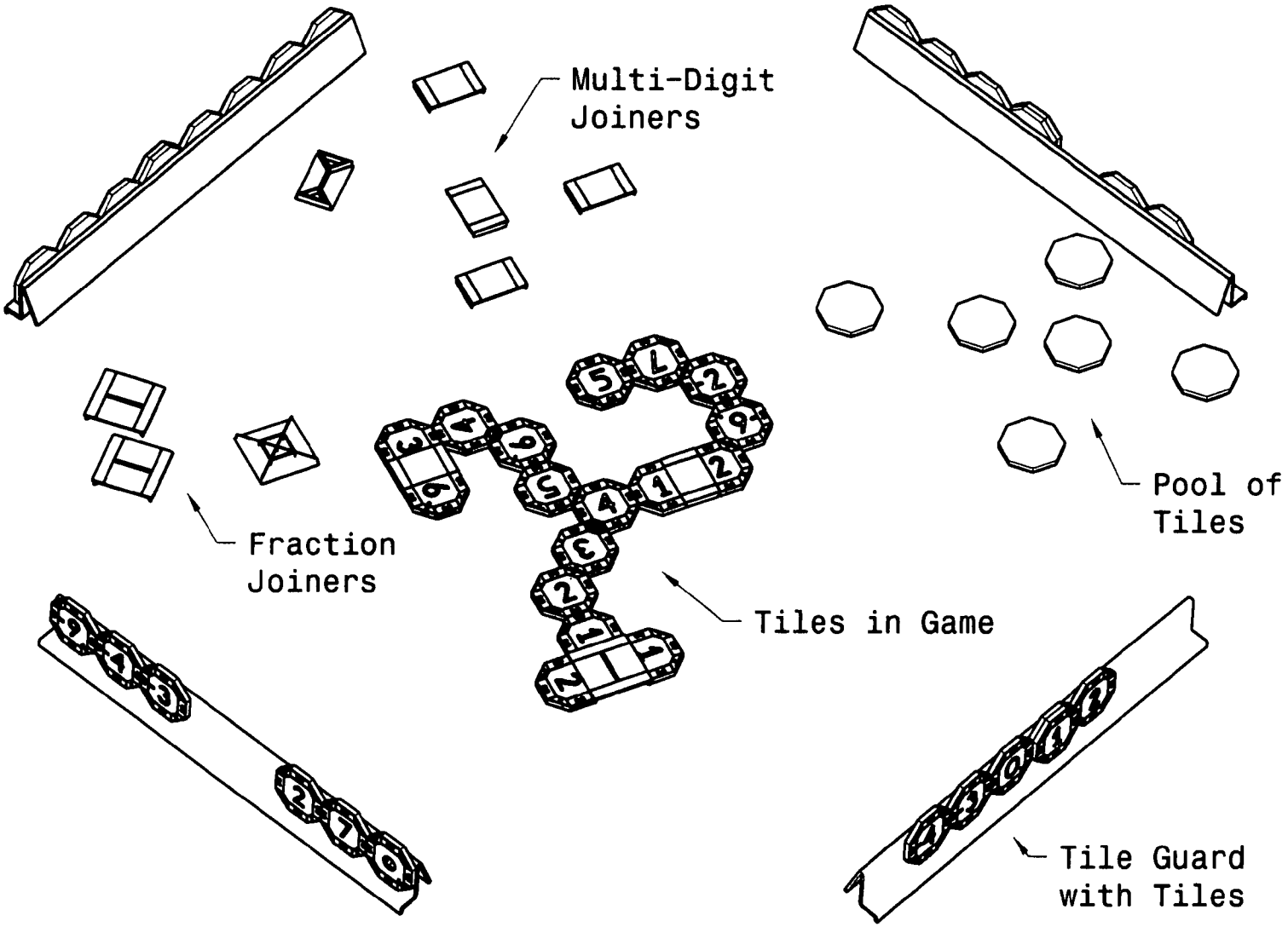
FIG. 1 shows a perspective view of simplified game layout as it may look over the course of the game.
Figure 2B:
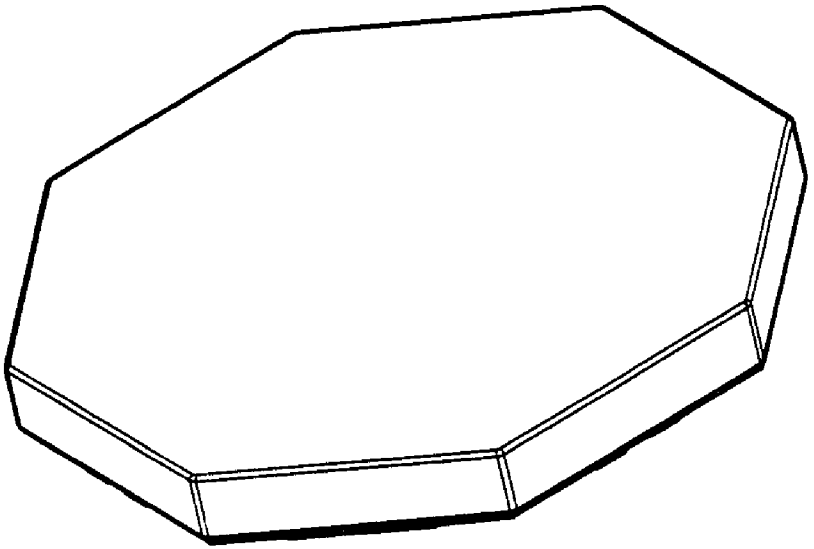
FIG. 2B is a perspective view of the main tile with face side down
Figure 2A:
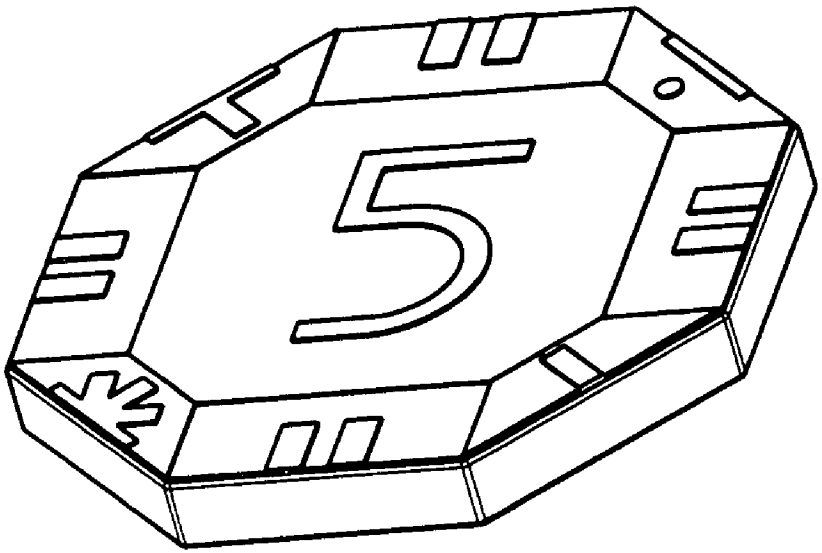
FIG. 2A is a perspective view of the main tile with face side up

FIG. 1 shows a simple game layout as it may look over the course of the game. It contains:

a) A pool of tiles
b) Tiles in game (assembled in math operations)
c) Tile guards with tiles
d) Multi-digit joiners
e) Fraction joiners FIG. 2A and FIG. 2B show sample of the Main Tile that has octagonal shape.

Standard game set includes five sets with digits from 0 to 9, five sets with negative digits from −1 to −9, and five "wildcard" tiles with the sun pictures instead of numbers on the front tile face. Other game versions may contain different number of tile sets or tiles of one number type only. Tiles for kindergarten version can have dots instead of numbers.

Each side of the octagonal tile bears different math symbol, or preferably half of it. The adding (+) and subtracting (−) symbols are on opposite sides of the tile, as are the multiplying (×) and dividing (/) symbols. The four sides between them bare equal (=) signs. The sides can be colored with unique color strips for each math operation, yet the same on all tiles. The backside of the tile is flat and has uniform color or pattern.

The tiles are big enough to make the sign easy to see and thick enough to allow tiles to attach firmly to each other without a chance of overlapping.

The single tile constitutes the single digit number, but can also be used as a digit of more complex numbers (multi-digit and fraction numbers).

Figure 3B:
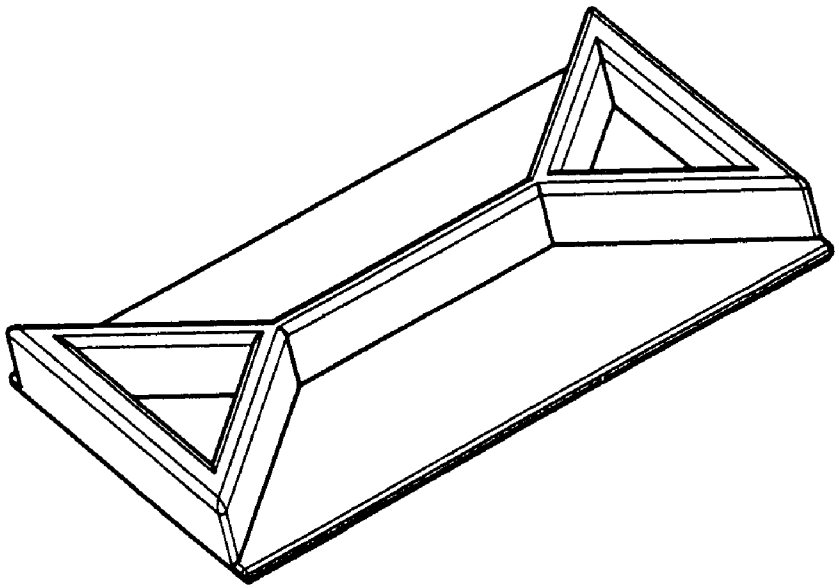
FIG. 3B is a perspective view of the multi-digit joiner with face side down
Figure 3A:
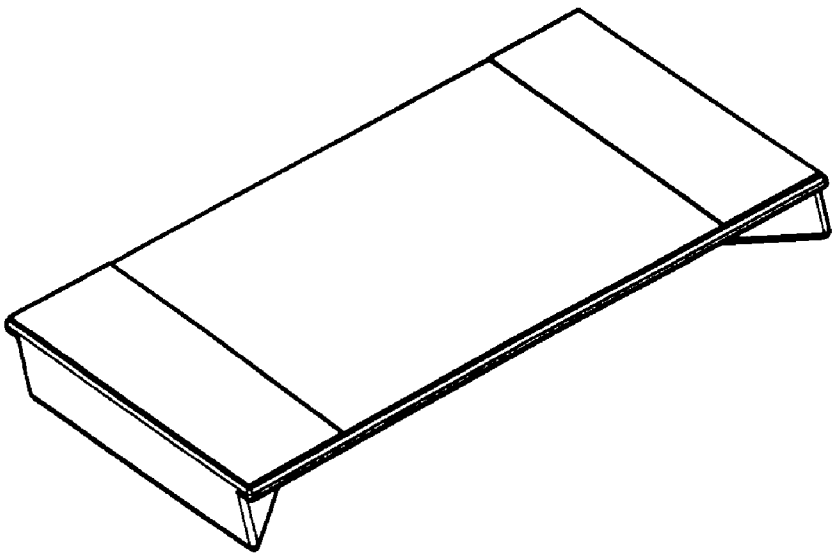
FIG. 3A is a perspective view of the multi-digit joiner with face side up

FIG. 3A and FIG. 3B show Multi-digit Joiner. Standard game set contains 24 such joiners.

The joiner is the rectangular-shape plate with locating ribs allowing quick and precise alignment of the two tiles joined with sides. The short sides of the octagon should have the same color strips as the "=" sign sides. The plate should be thin but firm, while the height of the underneath ribs to be same as main tile thickness.

Figure 4B:
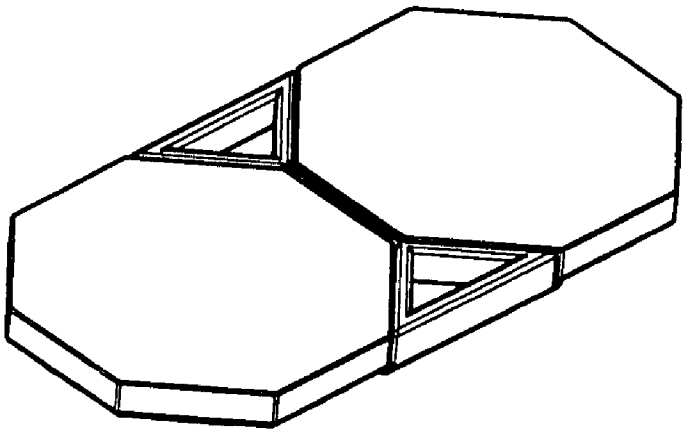
FIG. 4B is a perspective view of a two-digit number with face sides down
Figure 4A:
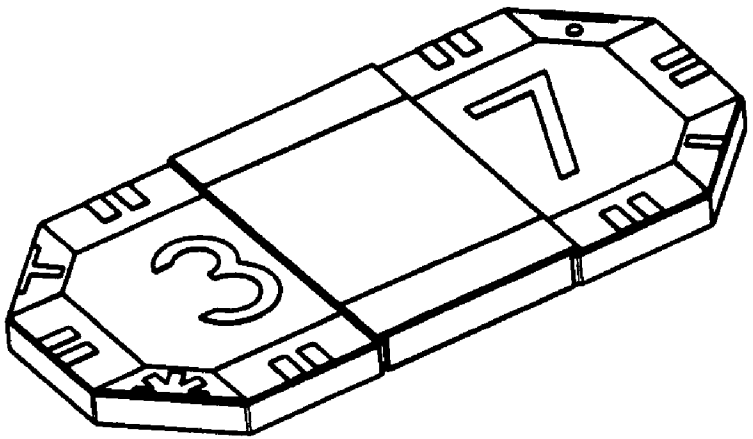
FIG. 4A is a perspective view of a sample of the two-digit number with face sides up

FIG. 4A and FIG. 4B show how the multi-digit number is formed. Two tiles (number digit) are attached to each other with their sides, while the placed above them multi-digit joiner covers the adjacent tile sides and their math symbols. Formed this way number has eight sides, four of them baring unique math symbols. Three or more digit numbers can be created via joining more tiles together.

Figure 5B:
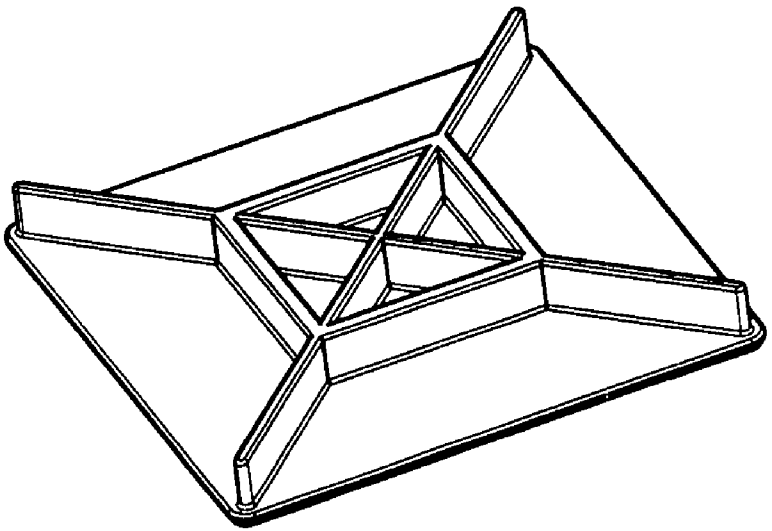
FIG. 5B is a perspective view of the fraction joiner with face side down
Figure 5A:
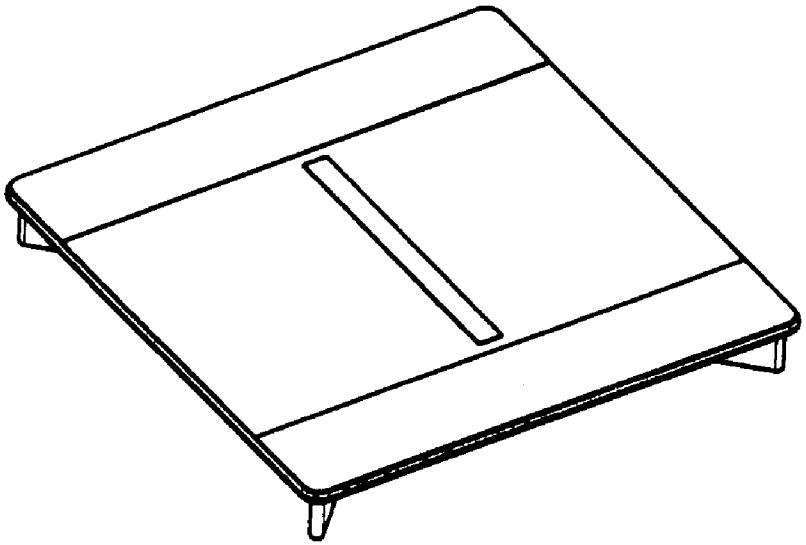
FIG. 5A is a perspective view of the fraction joiner with face side up

FIG. 5A and FIG. 5B show Fraction Joiner. Standard game set contains 12 such joiners.

The joiner is the square-shape plate with locating ribs allowing for precise alignment of two main tiles (numerator and denominator) as well as integer number in front of the fraction. The front face of the joiner has division bar painted in the middle. Sides perpendicular to the division bar should have same color strips as the "=" sign sides. The plate should have same thickness as the plate of the multi-digit joiner, while the height of the underneath ribs to be same as main tile thickness.

Figure 6B:
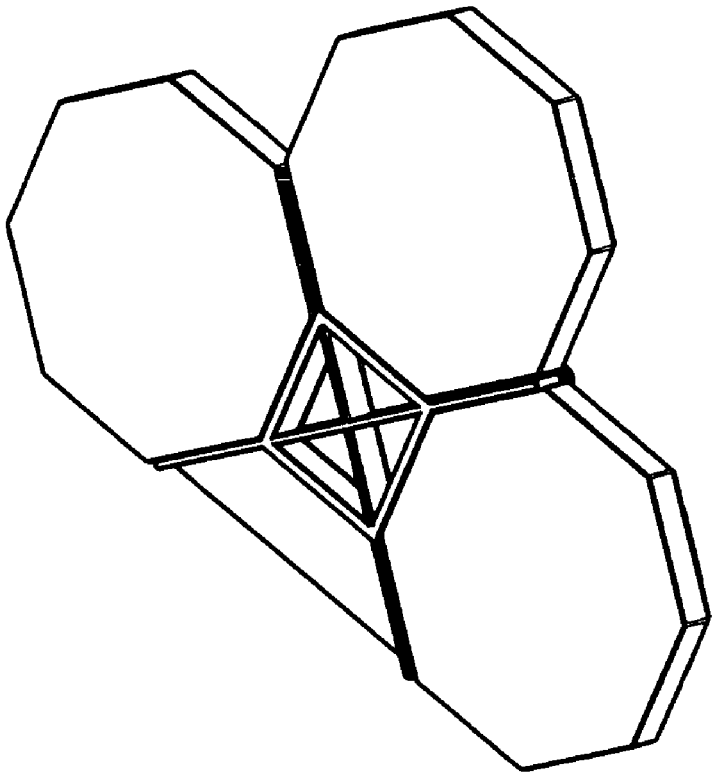
FIG. 6B is a perspective view of a two-digit number with face sides down
Figure 6A:
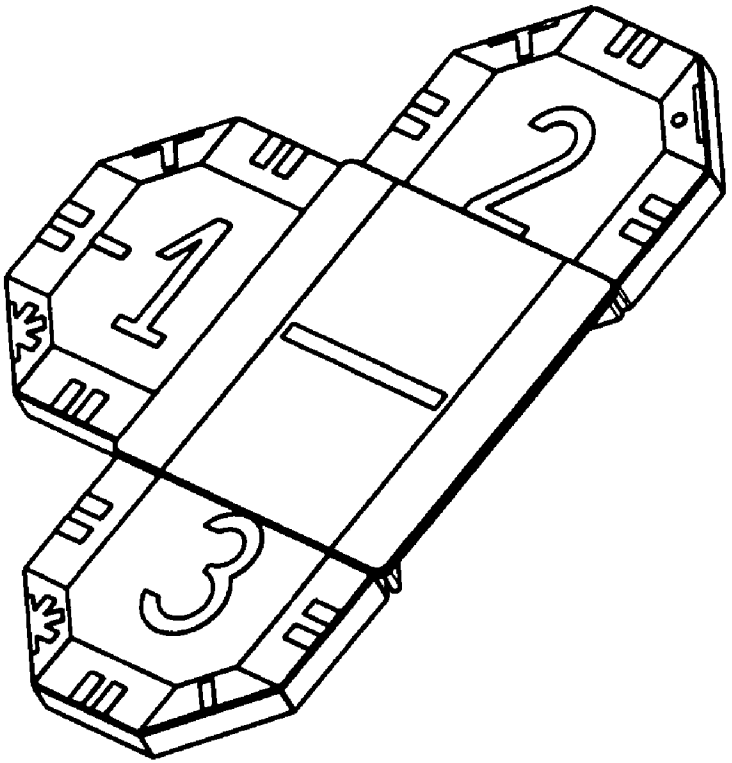
FIG. 6A is a perspective view of a sample of the fraction number with face sides up
Figure 7:
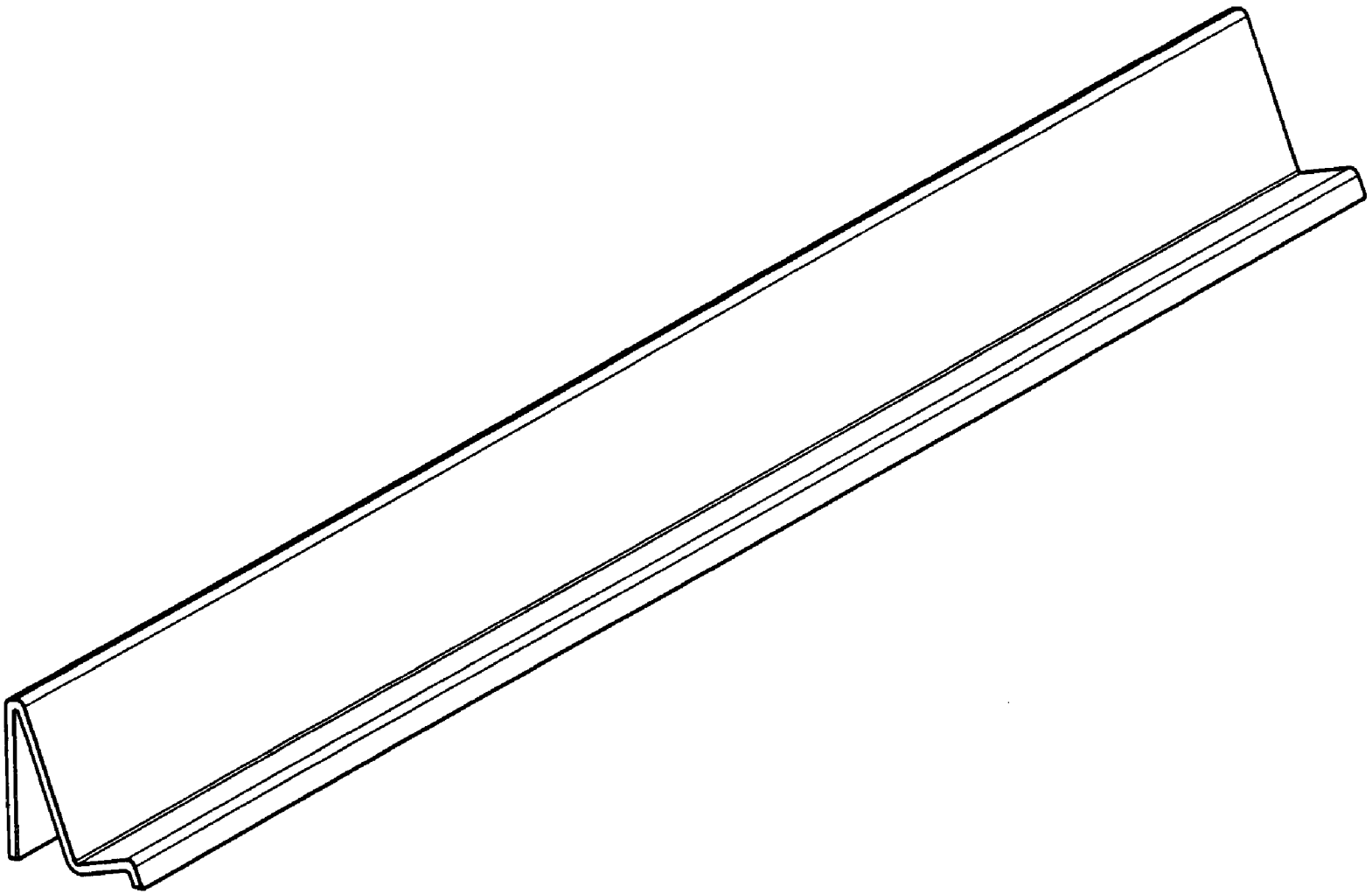
FIG. 7 is perspective drawing of the tile guard

FIG. 6A and FIG. 6B show how the fraction number is formed. Two tiles (numerator and denominator) form the fraction as they are attached to fraction joiner that covers their non-active sides. Additional tile (integer number) can be added in front of the fraction by attaching FIG. 7 shows Tile Guard. Standard game set contains 4 such guards. It allows the players to keep the tiles organized and hidden from other players.

The guard is composed of two non-flat plates: base plate and resting plate. Resting plate is located approximately 80 degrees to the base plate to allow the tiles to lean against. The resting plate height should be approximately 75% of the tile size to allow tiles to rest firmly and allow other players to see number of tiles the player owns (see Guide with Tiles in FIG. 1). Base plate should be wide enough to accommodate 3 tiles stack together and leaning against the resting plate.

Figures 8A, 8B, 8C:
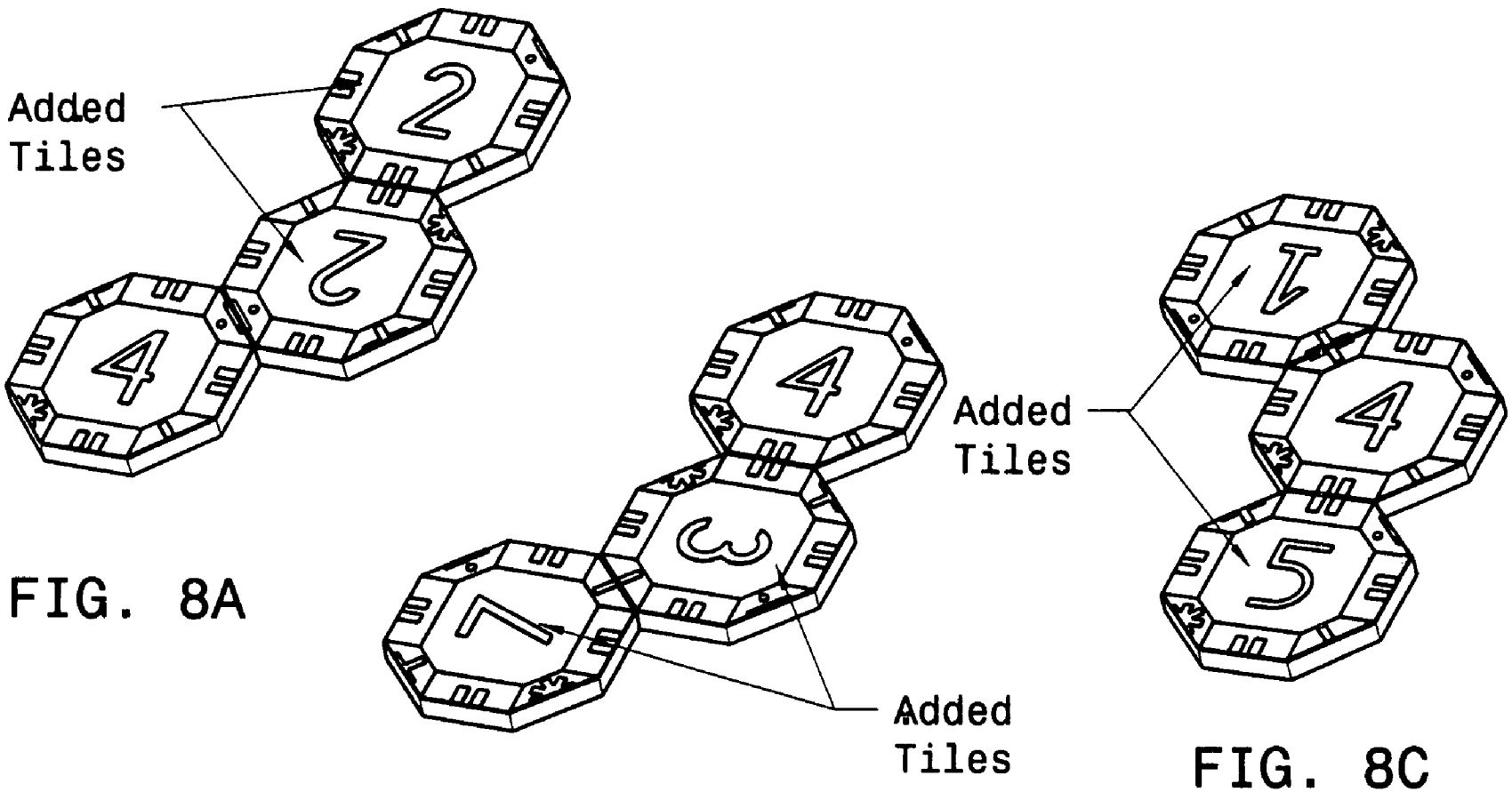
FIG. 8A shows forward move type.
FIG. 8B shows backward move type.
FIG. 8C shows split-operation move type.

FIG. 8A, B, C show different move iteration/math operations a) FIG. 8A shows the forward move. The player attaches his number (2) to a number from the table (4) matching the same math sign sides (creating math operation). Then he/she attaches to the added number another number (2) that is the result of the created math operation matching "=" sides.

b) FIG. 8B shows the backward move. The joins two his numbers (7 and 3) with sides of the same math sign (creating math operation). Then he attaches the created assembly to the number from the table (4) that is the result of the math operation matching "=" sides.

c) FIG. 8C shows the split operation move. The player attaches one his numbers (1) to the number from the table (4) matching the same math signs (creating math operation). Then he/she attaches to the original number from the table (4) another number (5) that is the result of the created math operation matching "=" sides.

Figure 9:
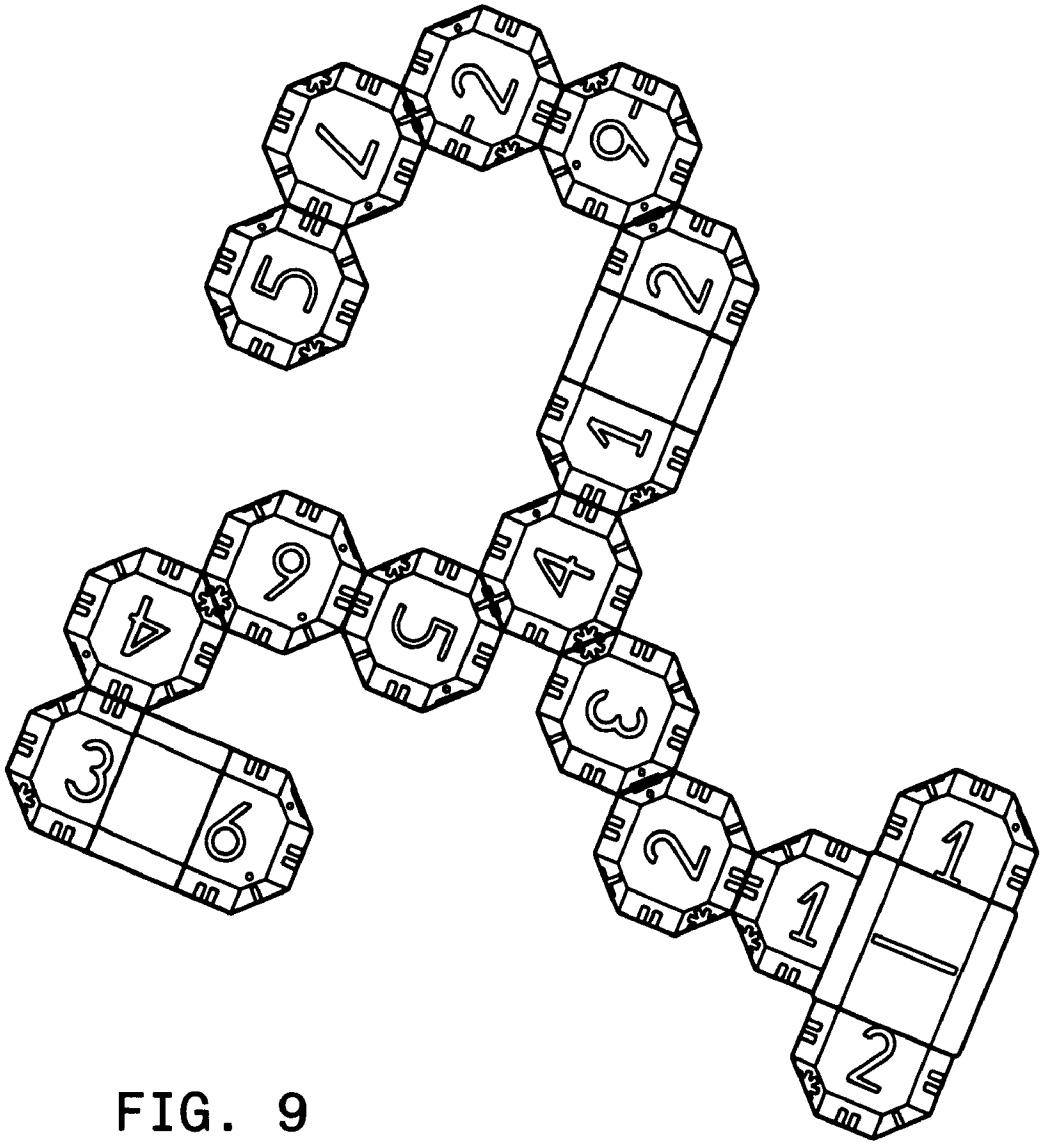
FIG. 9 is a top view of possible tile layout that demonstrates the math game method according to the present invention.

FIG. 9 shows top overview of the tile layout as it may look during the course of the game. Together with FIG. 1 it will be used to explain the game method:

a) Each player receives equal number (6-10) of randomly selected tiles that he/she keeps hidden from others behind tile guards. The remaining tiles are kept face side down (in the pool)

b) One randomly selected tile from the pool is placed on the table face side up.

c) First (and each subsequent) player attaches his tiles to the tile(s) from the table creating math equations.

d) The players alternate turns and pick up one tile from the pool after each move.

e) If the player is not able to make a move he/she looses his/her turn.

f) Before each turn the player may exchange the wild tile(s) from the table for the tile(s) that bear appropriate number.

g) The player exhausting his/her tiles first wins h) The game continues between the remaining players for the subsequent places.

The invention claimed is:

1. A kit for a math game, comprising:

(a) a plurality of game tiles, each of the game tiles being generally planar having opposed front and back faces, each of the game tiles being generally octagonal in shape defined by eight edges, the front face of each of the game tiles including a number and eight half symbols arranged around the number, each of the half symbols associated with and located proximate to a respective one of the edges, each of the game tiles configured so that any edge of a first game tile can adjoin any edge of a second game tile, the first and second game tiles being adjacently arrangeable with respective edges adjoining and the front faces visible so that the half symbol of the respective edge of the first game tile corresponds with the half symbol of the respective edge of the second game tile and forms one of a plurality of mathematical symbols when the respective edges are adjoined; and (b) a plurality of multi-digit tile joiners for forming a multi-digit number from two of the game tiles, each of the multi-digit tile joiners including a plate and a locating rib underneath the plate, the locating rib extending inwardly along sides of the plate, the locating rib having a height relative to the sides of the plate that is generally the same as a thickness of the games tiles between the front and back faces, the two of the game tiles being adjacently arrangeable with the front faces facing the side of the plate and particular edges of the two of the games tiles aligned and separated by the locating rib such that the half symbols of the particular edges of the two of the game tiles are covered by the plate.

2. The kit of claim 1, wherein the mathematical symbols are selected from the group consisting of addition, subtraction, multiplication, division and equality.

3. The kit of claim 2, wherein, on the front face of each of the game tiles the half symbol for equality is located proximate to every other edge.

4. The kit of claim 3, wherein, on the front face of each of the game tiles the half symbols for addition, subtraction, multiplication and division are located proximate to the remaining edges, such that there is a different arithmetic operation symbol per each of the remaining edges.

5. The kit of claim 4, wherein the edges on the front face of each of the game tiles includes color coding corresponding to the respective half symbol for simplifying matching of the edges of the game tiles.

6. The kit of claim 5, wherein the number is a single digit number.

7. The kit of claim 6, wherein, for at least a portion of the game tiles, the number is an integer selected from the group consisting of 0 to 9.

8. The kit of claim 7, wherein, for at least a portion of the game tiles, the number is an integer selected from the group consisting of −1 to −9.

9. The kit of claim 8, wherein, for at least a portion of the game tiles, the number includes a picture for conveying that the game tile is a wildcard game tile.

10. The kit of claim 1, further comprising a plurality of fraction tile joiners for forming a fraction number from another two of the game tiles, each of the fraction tile joiners including a second plate, a second locating rib and a division bar, the second plate including opposed first and second sides, the second locating rib extending along the first side of the second plate, the division bar visible on the second side of the second plate, the second locating rib having a height relative to the first side of the second plate that is generally the same as the thickness of the games tiles between the front and back faces, the another two of the game tiles being adjacently arrangeable with the front faces facing the first side of the plate and particular edges of the another two of the games tiles aligned and separated by the second locating rib such that the half symbols of the particular edges of the another two of the game tiles are covered by the plate, and the division bar is positioned between the numbers of the another two of the game tiles.

11. The kit of claim 1, further comprising a plurality of tile guards, each of the tile guards including a base plate and a resting plate coupled to the base plate and inclined at angle relative to the base plate, the base and resting plates configured to support several of the game tiles in an erect position.

* * * * *